United States Patent [19]

Kim

[11] 4,417,611

[45] Nov. 29, 1983

[54] SCREWDRIVER

[76] Inventor: Jung S. Kim, 7414 Denny Ave., Sun Valley, Calif. 91352

[21] Appl. No.: 352,776

[22] Filed: Feb. 26, 1982

[51] Int. Cl.[3] ..... B25G 1/00

[52] U.S. Cl. ..... 145/61 EA; 145/61 G; 145/61 L

[58] Field of Search ..... 145/61 EA, 61 E, 61 G, 145/61 L

[56] References Cited

U.S. PATENT DOCUMENTS

| | | | |
|---|---|---|---|
| 861,010 | 7/1907 | Zeman | 145/61 EA |
| 1,562,810 | 11/1925 | Towl | 145/61 G |
| 1,816,359 | 7/1931 | Carlin | 145/61 G |
| 2,418,638 | 4/1947 | Hoover | 145/61 EA |
| 2,465,152 | 3/1949 | Ellison | 145/61 EA |
| 2,564,356 | 8/1951 | Dianda | 145/61 EA |
| 4,093,008 | 6/1978 | Martin | 145/61 EA |

FOREIGN PATENT DOCUMENTS

| | | | |
|---|---|---|---|
| 547452 | 10/1957 | Canada | 145/61 EA |
| 693157 | 8/1930 | France | 145/61 EA |

*Primary Examiner*—James G. Smith
*Assistant Examiner*—J. T. Zatarga
*Attorney, Agent, or Firm*—John T. Matlago

[57] ABSTRACT

A screwdriver is provided with a handle which includes a wheel member and a head member. The wheel member is formed about the upper portion of the shank of the screwdriver and is anchored to rotate therewith. The head member is mounted by ball bearing assemblies to bear against the upper end of the shank and the wheel member. This enables the palm of the hand of the user to exert a downward pressure on the stationary head member to hold the wedged shaped end of the shank in a slot on a screw head while the fingers of the hand can be used to manipulate the rotation of the wheel member to thereby rotate the shank to drive the screw.

2 Claims, 5 Drawing Figures

18
14
23
20
10
11
12
16
15
13
17

57
46
25
56
31
46
47
43
49
45
18
28
32
38
4
4
35
33
36
26
14
23
20
21
11
10
12

11
21
21
10

23
38
20
18
11

46
56
25
19
31
57
43
47
45
49
51
18
50
28
40
37
35
41
38
33
39
26
11

SCREWDRIVER

BACKGROUND OF THE INVENTION

This invention relates to screwdrivers and more particularly to an improved structure therefor.

Many people find it difficult to use the conventional screwdriver to drive screws, particularly if the screws happen to have a relatively tight fit in their placing. This is because of the need to simultaneously press down on and rotate the relatively small diameter handle of the conventional screwdriver. It is especially a cumbersome task sometimes to keep the wedged shaped lower end of the shank of the screwdriver from slipping out of the slot in the screwhead while manipulating the handle of the screwdriver to provide these two different actions.

Accordingly, one of the objects of the present invention is to provide a low cost, improved screwdriver.

Another object of the present invention is to provide a screwdriver that facilitates the advancing or retracting of a screw in its placing.

With these and other objects in view, the invention consists of the construction, arrangement and combination of the various parts of the device whereby the objects contemplated are attained as hereinafter set forth, pointed out in the appended claims and illustrated in the accompanying drawings.

DRAWING SUMMARY

Figure 2:
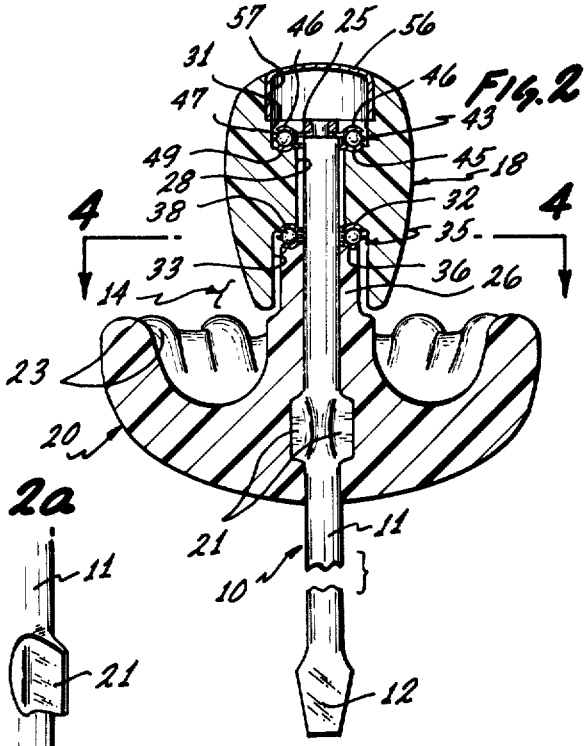
FIG. 2 is a vertical sectional view of the handle portion of the screwdriver.
Figure 2A:
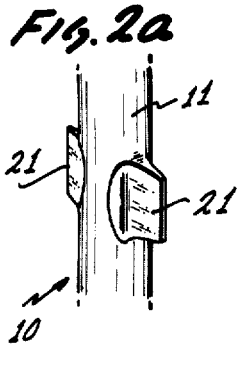
Figure 4:
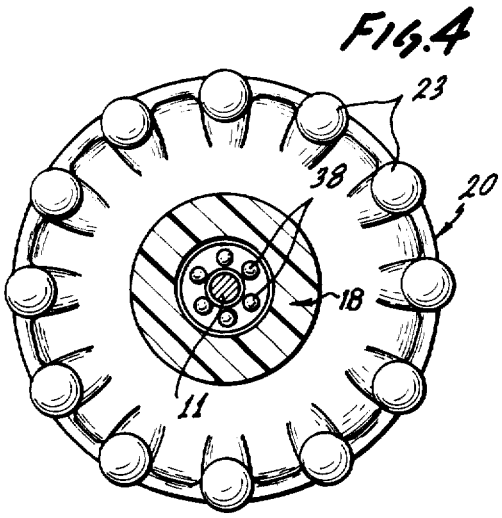
Figure 3:
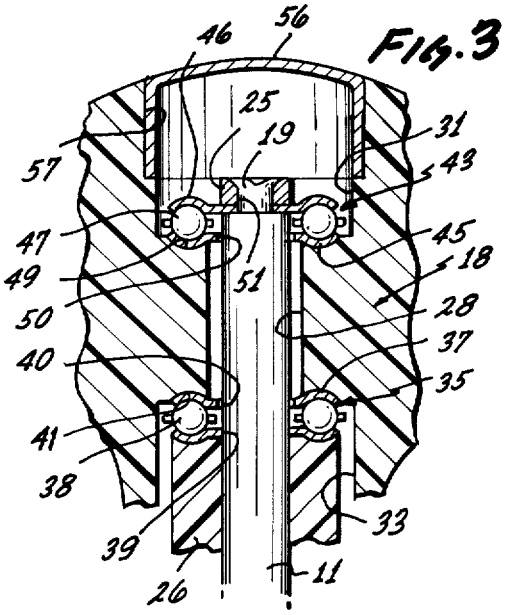

FIG. 2*a* is a perspective view of a portion of the shank;

FIG. 3 is an enlarged partial view of the head member portion of the screwdriver; and FIG. 4 is a sectional view as taken on line 4—4 of FIG. 2.

PREFERRED EMBODIMENT

Referring to the drawings, a screwdriver 10 is shown comprised of a shank 11 having a thin wedged shaped lower end 12 and a handle 14 on the upper end portion thereof. The handle 14 includes a head member 18 and a wheel member 20. The wheel member 20 has an outer diameter on the order of twice that of the head member 18.

The wheel member 20 which is formed of plastic is preferably molded concentrically about the shank 11 at a location spaced a short distance below the upper end thereof. A pair of diametrically disposed lugs 21 integrally formed on the shank 11 (FIG. 2*a*) help to anchor the wheel member 20 thereon. The wheel member 20 may be preferably dish shaped and formed with spaced projections 23 about the outer upper periphery thereof. A hub 26 is formed on the upper end of the wheel member 20.

The head member 18 which is also formed of plastic is molded with a central hole 28 along the axis thereof having an enlarged cylindrical opening 31 on the upper end portion thereof and an enlarged cylindrical opening 33 on the lower end portion thereof.

A lower ball bearing assembly 35 comprising a lower cage 36 and an upper cage 37 which encloses six equally spaced ball bearings 38 is placed within the lower enlarged opening 33 of the head member 18 so as to be seated against the shoulder 41 provided by the upper end thereof. It should be noted that the central opening 39 of the lower cage 36 is preferably of a size to have a close fit on the shank 11 while the central opening 40 of the upper cage 37 is of a size to have a loose fit thereon.

An upper ball bearing assembly 43 comprising a lower cage 45 and an upper cage 46 which encloses six equally spaced ball bearings 47 is placed within the upper enlarged opening 31 of the head member 18 so as to be seated against the bottom 49 thereof. It should be noted that the central opening 50 of the lower cage 45 is of a size to freely fit on the shank 11 whereas the upper cage 46 is formed with a small central hole 51.

The head member 18 with the upper and lower ball bearing assemblies 43 and 45 seated therein is positioned over the upper end of the shank 11 such that the lower enlarged opening 33 thereof loosely fits over the hub 26 on the wheel member 20. When so positioned, the shank 11 freely passes through the central opening 50 in the lower cage 45 of the upper ball bearing assembly 43 and through the central opening 40 of the upper cage 37 of the lower ball bearing assembly 35. As noted, the lower cage 36 of the lower ball bearing assembly 35 is seated on the upper end of the hub 26 while the central hole 51 on the upper cage 46 of the upper ball bearing assembly 43 is fitted over a small projection 19 provided on the upper end of the shank 11. A collar 25 is then positioned over the projection 19 which latter is then peened over, as shown, to thereby hold the head member 18 on the shank 11 above the wheel member 20.

A metal cylindrical cover 56 with a slightly rounded upper surface is then secured with a press fit in a recess 57 provided in the upper portion of the wall of the upper enlarged opening 31. When so positioned, the top surface of cap 56 is flush with the top of the head member 18.

It should now be clearly understood that the lower cage 45 of the upper ball bearing assembly 43 and the upper cage 37 of the lower ball bearing assembly 35 are both seated in the head member 10 and fixed in position by an adhesive, for example. On the other hand, the upper cage 46 of the upper ball bearing assembly 43 is fixed by collar 25 to rotate with the shank 11 and the lower edge 36 of the lower ball bearing assembly 35 is seated on the end of hub 26 of the wheel member 20 and is fixed in position by an adhesive, for example. In particular, the lower ball bearing assembly 37 operates as a thrust bearing to transfer a downward pressure exerted on the head member 18 onto the shank 11 while the upper ball bearing assembly 43 primarily serves to keep the axis of the head member 18 aligned with the axis of the shank 11.

It should now be clearly understood that the wheel member 20 and the shank 11 are thus able to be rotated together as a unit relative to the head member 18 which is held stationary during the operation of driving a screw.

Figure 1:
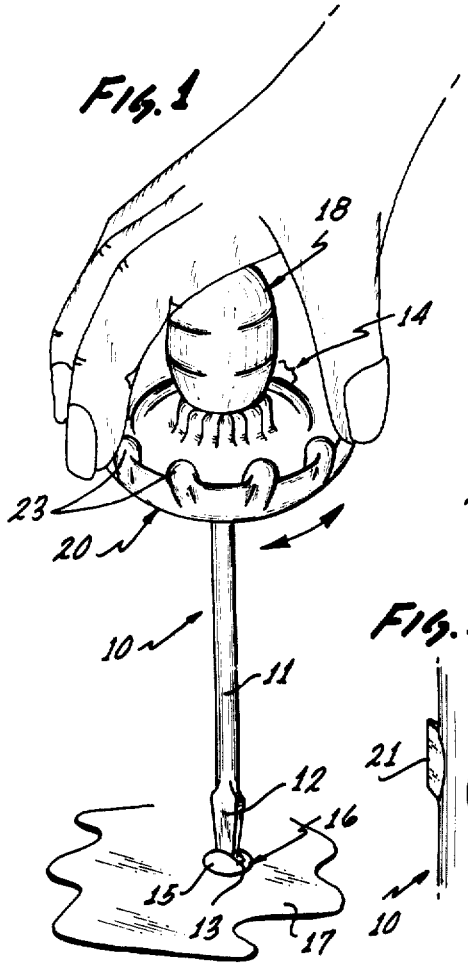
FIG. 1 is a perspective view of the screwdriver of the present invention illustrating its use.

The screwdriver 10 can be operated by one hand of the user to advance or retract a screw. As illustrated in FIG. 1, the screwdriver 10 is positioned with its wedged shaped lower end 12 fitted in a slot 13 provided in the screw head 15 of a screw 16 to be driven in a part 17. The hand of the user is positioned with the palm thereof pressing down on the top of the head member 18, and with the fingers thereof being free to grip the upper extending projections 23 on the outer periphery of the wheel member 20 to rotate the same.

It should be evident that with the palm pressing down on the top of the handle member 18, the fingers are free to reposition themselves about the periphery of the wheel member 20 to continue the rotation thereof, as needed. As previously pointed out, the head member 18 does not rotate with respect to the palm of the hand.

Inasmuch as the outer diameter of the wheel member 20 is on the order of twice the outer diameter of the head member 18, the shank 11 of the screwdriver 10 can be readily twisted by the fingers because of the rotary mechanical advantage afforded thereby while the wedged shaped end 12 of the shank 11 can be held inserted in the slot 13 of the screw head by the downward pressing of the palm of the hand on the upper surface of the cover 56 of the head member 18.

It should be particularly noted that the screwdriver 10 of the present invention is light in weight because both the wheel member 20 and the head member 18 are formed of plastic.

While the preferred embodiment of the device as described herein is well adapted to fulfill the objects and advantages previously mentioned as desirable it is to be understood that the invention is not limited to the specific features shown and described but that the means and configurations herein disclosed are susceptible of modification in form, proportion and arrangement of parts without departing from the principles involved or sacrificing any of its advantages and the invention is, therefore, claimed in embodiments of various forms all coming within the scope of the claims which follow.

What is claimed is:

1. A screwdriver comprising:

a shank having a wedged-shaped lower end;

a handle for said shank including a head member and a wheel member;

said head member provided with an axial hole therethrough having a diameter larger than said shank and having enlarged central openings on the upper and lower end portions thereof;

said wheel member having a relative large diameter with upwardly extending spaced projections on the outer periphery thereof and having a hub portion on the upper end thereof;

said wheel member anchored on said shank so as to be positioned below the upper end portion thereof;

a lower ball bearing assembly seated within the central opening on the lower end portion of said head member;

an upper ball bearing assembly seated within the central opening on the upper end portion of said head member;

said head member positioned with its axial hole surrounding the upper end portion of said shank and with said lower ball bearing assembly rotatably journalling the lower end portion of said head member on the top surface of the hub portion of said wheel member and with said upper ball bearing assembly rotatably journalling and axially retaining the upper end portion of said head member on the upper end of said shank;

whereby an axial force can be applied by the palm of the hand of a user on the head member to hold the wedge-shaped lower end of the shank in a slot on a screwhead while the fingers of the hand can be used to grip the projections on the periphery of the wheel member to thereby rotate the shank to advance or retract said screw.

2. A screwdriver as claimed in claim 1 wherein said lower ball bearing assembly includes a ball bearing upper race member seated in the central opening on the lower end portion of said head member and a ball bearing lower race member seated on the top surface of the hub portion of said wheel member; and said upper ball bearing assembly includes a ball bearing lower race member seated in the central opening on the upper end portion of said head member and a ball bearing upper race member having its center secured to the upper end of said shank.

* * * * *